US008729373B2

(12) United States Patent
Quealy et al.

(10) Patent No.: US 8,729,373 B2
(45) Date of Patent: May 20, 2014

(54) CUPPING DEVICE FOR ATTACHMENT TO A HARMONICA HOLDER

(76) Inventors: James Patrick Quealy, Seal Beach, CA (US); Dennis Quealy, Bethpage, NY (US)

( * ) Notice: Subject to any disclaimer, the term of this patent is extended or adjusted under 35 U.S.C. 154(b) by 0 days.

(21) Appl. No.: 13/590,334

(22) Filed: Aug. 21, 2012

(65) Prior Publication Data

US 2014/0053706 A1 Feb. 27, 2014

(51) Int. Cl.
*G10D 7/12* (2006.01)

(52) U.S. Cl.
USPC ..... 84/377

(58) Field of Classification Search
USPC ..... 84/375, 377–379
See application file for complete search history.

(56) References Cited

U.S. PATENT DOCUMENTS 2,335,453 A * 11/1943 Scherer ..... 84/377
4,497,234 A * 2/1985 Strnad ..... 84/743

* cited by examiner

*Primary Examiner* — Kimberly Lockett
(74) *Attorney, Agent, or Firm* — Aaron P. McGushion

(57) ABSTRACT

The present cupping device attaches to the harmonica holder and provides a simulated cupping effect when the musician is playing the harmonica hands-free. The cupping device is generally a U-shaped elongate channel formed by bending a rigid sheet material to create a chamber. The elongate channel attaches to a harmonica holder and the open side of the elongate channel receives the back of a harmonica also mounted on the harmonica holder. Each end of the elongate channel is open to permit the ingress and egress of air while playing. A microphone may be clipped to one or both open ends and positioned within the elongate channel. The cupping device isolates the harmonica sound so that it can be amplified at higher volumes without feedback or interference.

7 Claims, 4 Drawing Sheets

CUPPING DEVICE FOR ATTACHMENT TO A HARMONICA HOLDER

BACKGROUND

The present device relates to an attachment for a harmonica, and more particularly, to an attachment for a harmonica which isolates the sound of the harmonica for improved quality and amplification.

Generally, when playing the harmonica to a large audience, a musician requires a microphone to amplify the sound. To achieve optimal tonal quality, volume, and isolation, the musician often cups the harmonica with one or both hands to create a sound chamber, with the microphone located within the chamber. The cupped hands method serves to focus the sound emitted from the harmonica towards the microphone, thus enhancing sound quality and volume. Further, the cupped hands method isolates the harmonica by blocking sounds from other instruments or feedback.

If the musician is playing another instrument in addition to a harmonica, such as a guitar, the musician will likely require a harmonica holder, also known as a neck rack. The harmonica holder is well known in the music industry, and generally is comprised of a U-shaped member that wraps around the neck and rests on the shoulders with two upwardly extending arms, one connected to each side of the U-shaped member. The upwardly extending arms are connected by a cross bar. A spring-loaded bar is connected to the upwardly extending arms and is permitted to slide up and down the arms, but being biased by springs towards the horizontal bar. The spring-loaded bar is slid down to create a space between it and the horizontal bar to fit the harmonica between the two. When released, the spring-loaded bar serves to clamp the harmonica between it and horizontal bar. The spring-loaded bar may include one or more tabs for locating the harmonica. The musician dons the harmonica holder by placing the U-shaped member about the neck to position the clamped harmonica just in front of the mouth.

Of course, if the musician's hands are occupied with playing the second instrument, the musician cannot cup the hands while simultaneously playing the harmonica. Thus, the musician is forced to play the harmonica is close proximity to a to a free-standing microphone or a microphone attached to the holder, which weakens the sound received by the microphone due to sound dispersal. This results in a thinner, and less controlled tone and volume.

Thus, what is needed is a device that can simulate the cupping of hands. The device should be light-weight, compact, and simple to attach. Further, the device should permit attachment of a microphone in a desired position relative to the harmonica.

SUMMARY

A cupping device is provided for attachment to a harmonica holder. The cupping device has a top wall, a back wall, and a bottom wall spaced apart from the top wall and connected to the top wall through the back wall. The top, back, and bottom walls define an elongate channel, with an open side opposite the back wall and a first open end opposite a second open end, each adjacent to the back wall. The bottom wall is configured to connect to the framework of the harmonica holder.

The harmonica is attached to the framework of the harmonica holder, where the harmonica is positioned with at least the back of the harmonica within the elongate channel.

The open ends permit air to move in and out of the elongate channel as the musician blows and draws through the harmonica.

Optionally, the bottom wall is removably attached to the framework of the harmonica holder, where the bottom wall is selectively held to the framework by a clip which captures a portion of the bottom wall and a portion of the framework to hold the cupping device to the harmonica holder. Further optionally, an engagement aperture is formed on the bottom wall, and is configured to receive a protruding portion of the framework. The clip is configured to hold the protruding portion in engagement within the engagement aperture.

Optionally, the elongate channel has an inside surface of the top wall, with the inside surface configured to face the harmonica. The inside surface terminates at a front edge, which is adjacent to the open side. A barrier strip is attached to the inside surface to fill at least a portion of the space between the top cover plate of the harmonica and the inside surface. The barrier strip substantially blocks the sound of the musician's breathing from the nose from entering the elongate channel.

Optionally, the elongate channel further comprises a first edge at the first open end and a second edge at the second open end, where the first edge and the second edge are configured to receive in clipped attachment a microphone. The microphone may have a cable and a spring clip attached to the cable in sliding engagement. Each of the first edge and the second edge are configured to receive the spring clip in clipped attachment. The position of the microphone within the elongate channel may be configured by adjusting the location of the spring clip along the cable.

The framework of the harmonica may include a first arm connected to a second arm through a cross bar, a spring loaded bar arranged parallel to the cross bar and attached to the first arm and the second arm in sliding engagement, where the spring loaded bar is biased towards the cross bar for clamping the harmonica therebetween. The bottom wall is configured to be removably attached to the spring loaded bar by a clip, where the clip is configured to capture the bottom wall and the spring loaded bar. The harmonica can be captured between the cross bar and the clip, with the spring loaded bar providing clamping pressure to hold the harmonica on the harmonica holder

DESCRIPTION OF THE PREFERRED EMBODIMENTS

Figure 1:
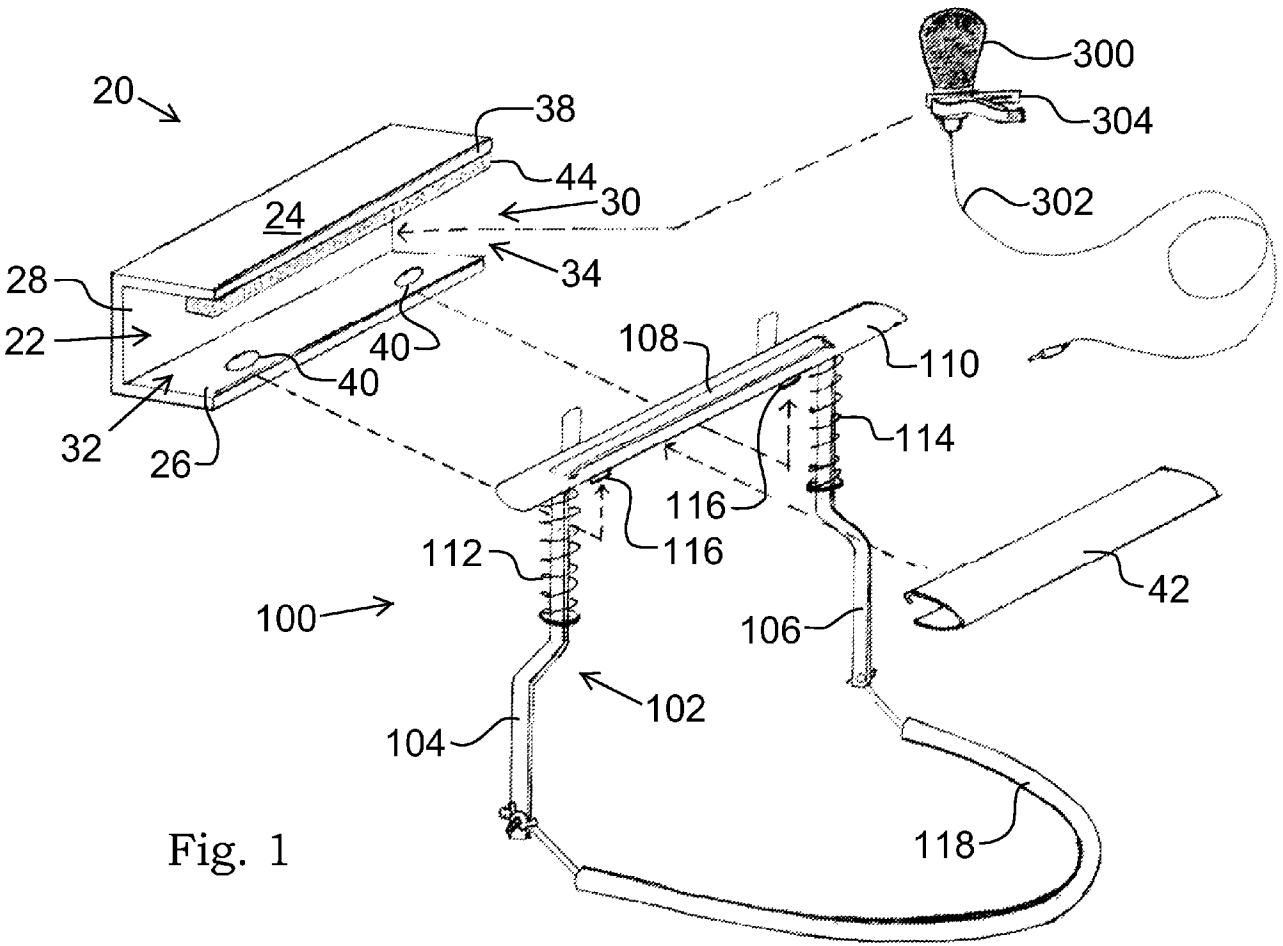
FIG. 1 is an exploded perspective view of the preferred embodiment of the cupping device, showing the cupping device in position to be assembled with the harmonica holder.
Figure 2A:
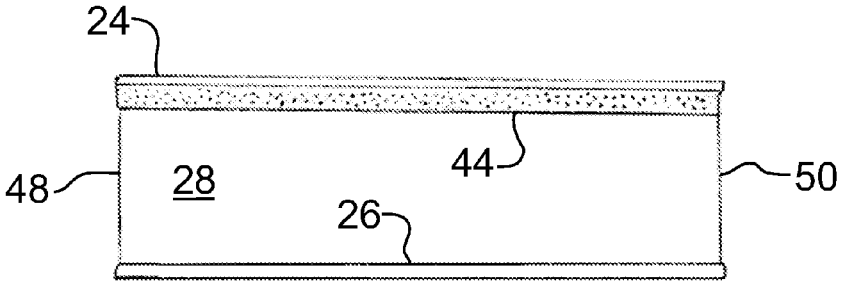
FIGS. 2A-C are a plan and perspective views of the clip and cupping device.
Figure 2B:
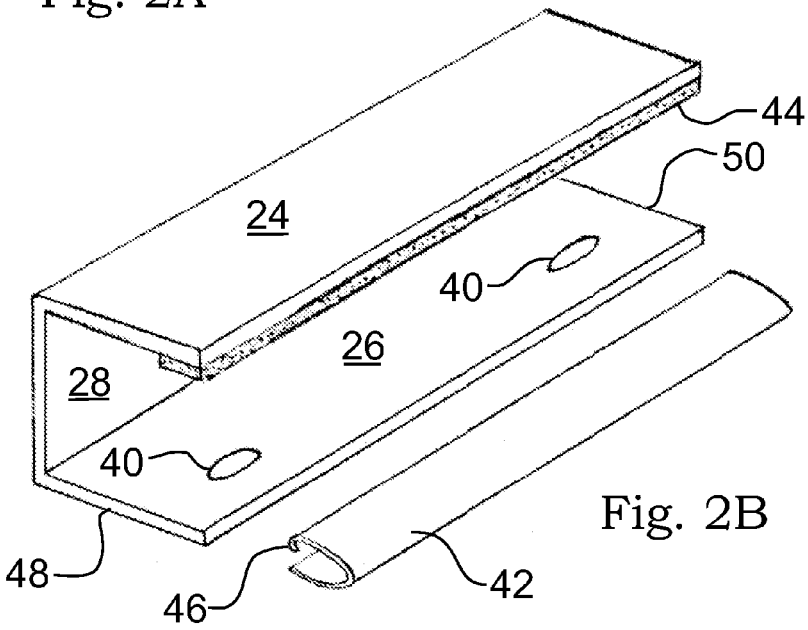
Figure 2C:
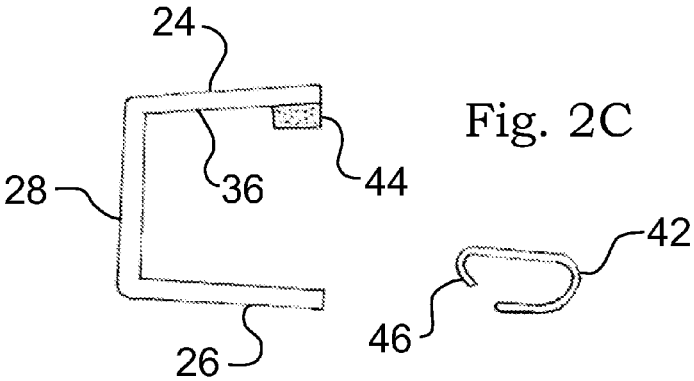

The detailed descriptions set forth below in connection with the appended drawings are intended as a description of embodiments of the invention, and is not intended to represent the only forms in which the present invention may be constructed and/or utilized. The descriptions set forth the structure and the sequence of steps for constructing and operating the invention in connection with the illustrated embodiments. It is to be understood, however, that the same or equivalent structures and steps may be accomplished by different embodiments that are also intended to be encompassed within the spirit and scope of the invention.

Looking first to FIG. 1 and FIGS. 2A-C, the cupping device (20) is shown in perspective as part of an exploded assembly comprising a harmonica holder (100), a microphone (300), and a clip (42). The cupping device (20) is shown as being generally U-shaped or channel shaped, although there are many cross-section shapes that are encompassed by the invention. The cupping device (20) has a top wall (24), a bottom wall (26), and a back wall (28) spanning between the top wall (24) and the bottom wall (26). The top wall (24), bottom wall (26), and back wall (28) are arranged to form an elongate channel (22), with an open side (30), a first open end (32), and a second open end (34). The first open end (32) defines a first edge (48); and the second open end (34) defines a second edge (50).

Two engagement apertures (40) are formed on the bottom wall (26) and are configured to receive the protruding portions (116) of the spring-loaded bar (110) of the harmonica holder (100). The protruding portions (116) may be tabs, rivets, stiffening ridges, and the like on any portion of the framework (102). Accordingly, the engagement apertures (40) may be through holes, indentations, elongated holes, or any appropriate shape such that they may mate with the corresponding protruding portions (116). Although two engagement apertures (40) are shown, one or more may be provided on the bottom wall (26) or other appropriate location on the cupping device (20).

Figure 4:
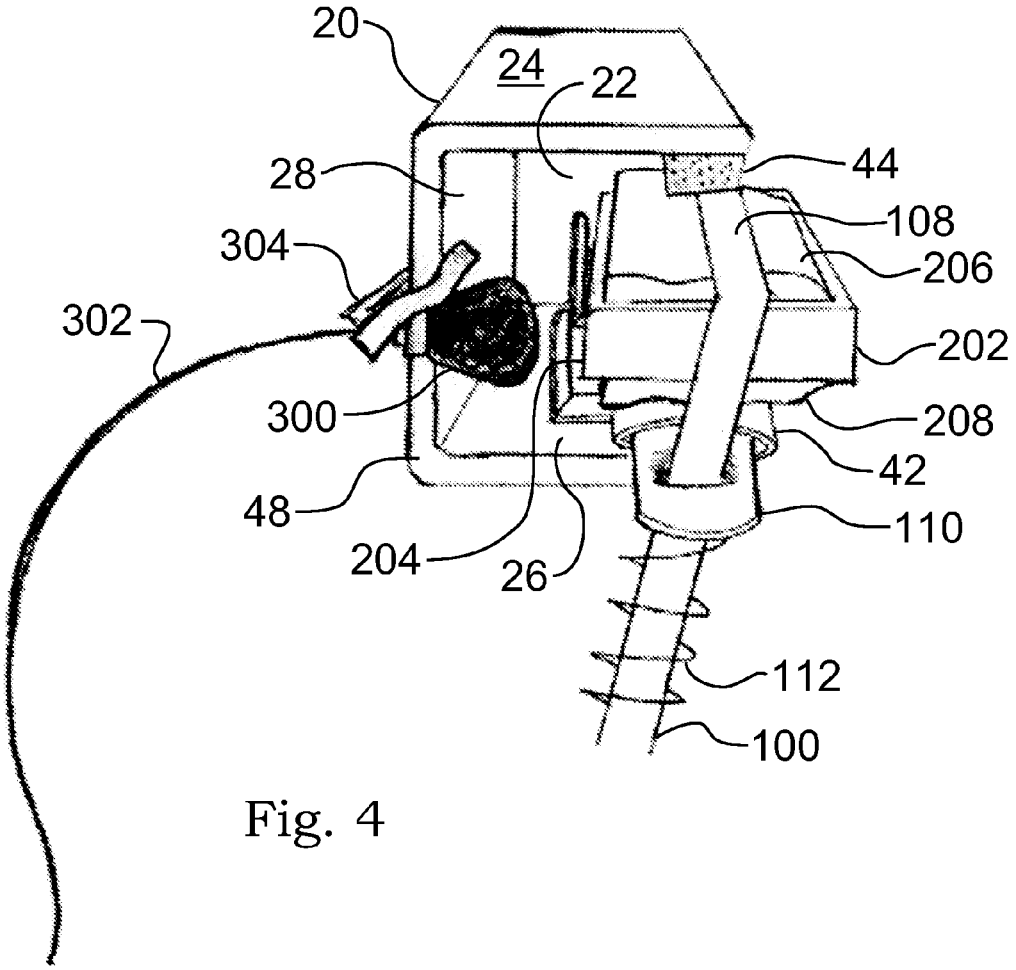
FIG. 4 is a side perspective view of the cupping device shown attached to a harmonica holder, with a harmonica held by the harmonica holder.

The top wall (24) has an inside surface (36) configured to face towards the elongate channel (22) and the harmonica (200) (as shown in FIG. 4). A barrier strip (44) is adhered or otherwise attached to the inside surface (36) along the front edge (38). The barrier strip (44) may be made of a variety of materials, with foam rubber being the preferred material due to its ability to absorb sound and compress when fitting the harmonica (200) within the harmonica holder (100).

Harmonica holders are known in industry and are made in a variety of configurations, with just one of many possible configurations shown in FIG. 1. The harmonica holder (100) generally has a U-shaped neck member (118) designed to wrap about the musician's neck and rest on the shoulders. At the free ends of the U-shaped member (118) a framework (102) is hinged, with a first arm (104) and a second arm (106) extending upwardly and connected by a cross bar (108). A spring-loaded bar (110) is slide over the arms (104, 106), held parallel to the cross bar (108) and spring biased towards the cross bar (108) by the coil springs (104, 106).

Normally, without the cupping device (20), the harmonica (200) would be clamped between the cross bar and the spring-loaded bar (110) under the clamping force of the springs (112, 114). The musician would pull the spring-loaded bar (110) away from the cross bar (108) and insert the harmonica (200). By releasing the spring-loaded bar (110) the cross bar (108) contacts the top cover plate (206) of the harmonica (200) and the spring-loaded bar (110) contacts the bottom cover plate (208) to hold the harmonica (200), as shown in FIG. 4.

Figure 3:
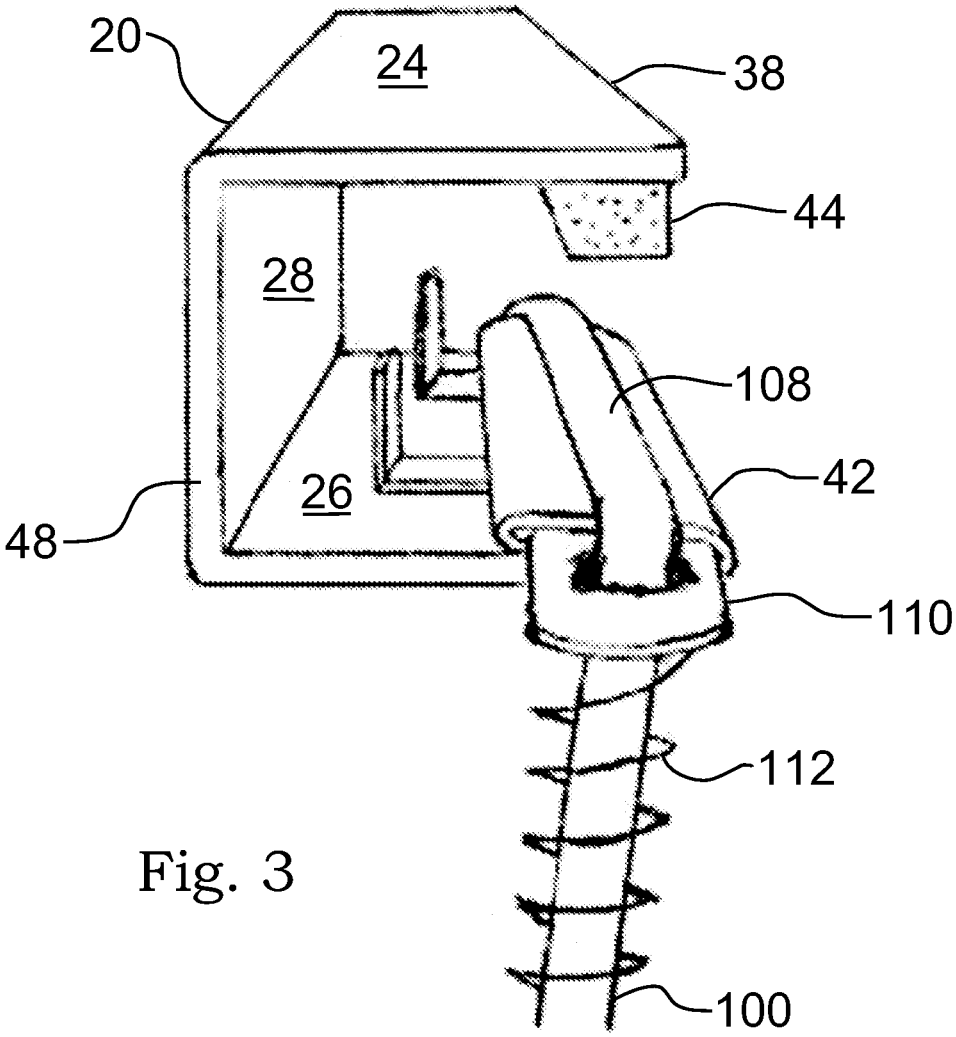
FIG. 3 is a side perspective view of the cupping device shown attached to a harmonica holder.

The present cupping device (20) attaches directly to the framework (102) of the harmonica holder (100) without substantially interfering with the clamping of the harmonica (200) by the cross bar (108) and the spring-loaded bar (110), as shown in FIG. 3. In the illustrated example, the engagement apertures (40) are brought in alignment with the protruding portions (116) of the spring-loaded bar (110). The protruding portions (116) are inserted into the engagement apertures (40) and held by hand while the clip (42) is expanded and installed over the bottom wall (26) and the spring-loaded bar (110). Once released, the clip (42) clamps the cupping device (20) to the harmonica holder (100), with the hooked edge (46) of the clip (42) preventing unintentional removal of the clip (42) by hooking on the spring-loaded bar (110) or similar part. The clip (42) may be made of vinyl or other resilient material. The insertion of the protruding portion (116) in the engagement aperture (40) serves to locate the cupping device (20) relative the framework (102) and prevents lateral movement of the cupping device (20). Once the cupping device is installed on the harmonica holder (100), the harmonica (200) can be added at any point without substantial interference from the cupping device (20) and clip (42). In this way, the musician can easily switch between harmonicas without removing the cupping device (20) or clip (42).

FIG. 4 illustrates the fully assembled example embodiment, showing the cupping device (20) attached to a harmonica holder (100) and the harmonica (200) attached to the harmonica holder (100) independent of the cupping device (20). The barrier strip (44) is shown attached to the inside surface (36). The barrier strip (44), foam rubber in this example, muffles the breathing sound of the musician, as she breathes in and out, and substantially prevents the breathing sound from entering the elongate channel (22) and being detected by the microphone (300). The microphone (300) is shown clipped to the first edge (48), although it can optionally be clipped to the second edge (50) and along any point of the edges (48, 50), including the edge of the top wall (24) or the bottom wall (26).

Furthermore, the clip (304) may optionally slid along the cable (302) so that the microphone (300) can be inserted further in the elongated channel (22). For example, the clip (304) may be adjusted down the cale (302) so that the microphone is positioned near the midpoint of the harmonica (200) back (204). The placement of the microphone (300) affects the dominate sounds picked up by the microphone (300). For example, placement of the microphone (300) to the left of the harmonica (200) by clipping the microphone (300) to the first edge (48) will more readily capture the lower notes and amplifying them at higher volume. Likewise, clipping the microphone (300) to the second edge (50) will amplify the higher notes. Multiple microphones (300) can be used if the musician desires, such as one clipped to each edge (48, 50).

An example cupping device (20) may be made of 0.080" of sheet material, preferably clear polycarbonate or acrylic. A mold is made to conform to the desired shape of the elongate channel (22) of the cupping device (20). Once the sheet material has been softened by heat, the sheet material can be pressed or conformed to the mold until cooled, thus permanently deforming the sheet material to the shape of the cupping device (20). The engagement apertures (40) can be drilled before or after molding. The vinyl clip (42) can be bent on the brake press or other forming process.

The placement of the microphone (300) to pick up sound emitted from the harmonica (200) within the chamber created by the elongated channel (22) permits the musician to amplify the sound at higher volumes without feedback. Further, the cupping device (20) allows the sound of the harmonica (200) to be isolated from the remaining instruments and microphones. In this way, the harmonica (200) signal can be equalized separately from the vocals, run through a separate amplifier or public address (PA) channel. The signal may be sent through a volume pedal or desired effects may be applied, such as a digital delay, analog delay, octave effects, reverb, echo, chorus, overdrive, distortion, and the like.

While particular forms of the invention have been illustrated and described, it will also be apparent to those skilled in the art that various modifications can be made without departing from the spirit and scope of the invention. Accordingly, it is not intended that the invention be limited except by the claims.

The invention claimed is:

1. A cupping device for attachment to a harmonica holder, the harmonica holder having a framework configured for holding a harmonica near a mouth of a musician, the harmonica having a back opposite the mouthpiece and a top cover plate opposite a bottom cover plate, the cupping device comprising:

a top wall, a bottom wall, and a back wall, the top wall is spaced apart from the bottom wall, the top wall is connected to the bottom wall through the back wall;

an elongate channel defined by the top wall, bottom wall, and back wall;

an open side of the elongate channel opposite the back wall;

a first open end adjacent the back wall; and a second open end opposite the first open end and adjacent the back wall;

wherein the bottom wall is configured to attach to the framework of the harmonica holder;

and wherein the harmonica is configured to be attached to the framework of the harmonica holder, and at least the back of the harmonica is configured to be received within the elongate channel when the harmonica is attached to the framework;

and wherein the first open end and the second open end permit movement of air in and out of the elongate channel as the musician blows and draws through the harmonica.

2. The cupping device of claim 1 wherein the bottom wall is removably attached to the framework of the harmonica holder, the bottom wall being selectively held to the framework by a clip which captures a portion of the bottom wall and a portion of the framework to hold the cupping device to the harmonica holder.

3. The cupping device of claim 2 wherein an engagement aperture on the bottom wall is configured to receive a protruding portion of the framework, the clip being configured to hold the protruding portion in engagement within the engagement aperture.

4. The cupping device of claim 1 wherein the elongate channel further comprises an inside surface of the top wall, the inside surface being configured to face the harmonica, the inside surface terminating at a front edge adjacent to the open side of the elongate channel, a barrier strip being attached to the inside surface along the front edge, the barrier strip filling a portion of a space between the top cover plate of the harmonica and the inside surface, the barrier strip substantially blocking the sound of the musician's breathing from the nose from entering the elongate channel.

5. The cupping device of claim 1 wherein the elongate channel further comprises a first edge at the first open end and a second edge at the second open end, the first edge and the second edge configured to receive in clipped attachment a microphone.

6. The cupping device of claim 5 wherein the microphone has a cable and a spring clip attached to the cable in sliding engagement, the first edge and the second edge each configured to receive the spring clip in clipped attachment, the position of the microphone within the elongate channel being configurable by adjusting the location of the spring clip along the cable.

7. The cupping device of claim 1 wherein:

the framework of the harmonica holder further includes a first arm connected to a second arm through a cross bar, a spring loaded bar arranged parallel to the cross bar and attached to the first arm and the second arm in sliding engagement, the spring loaded bar being biased towards the cross bar for clamping the harmonica therebetween;

the bottom wall is configured to be removably attached to the spring loaded bar by a clip, the clip configured to capture the bottom wall and the spring loaded bar;

wherein the harmonica is captured between the cross bar and the clip, with the spring loaded bar providing clamping pressure to hold the harmonica on the harmonica holder.

* * * * *